US007232090B2

(12) United States Patent
Moratto

(10) Patent No.: US 7,232,090 B2
(45) Date of Patent: Jun. 19, 2007

(54) SPINNING PAPER TOWEL HOLDER

(76) Inventor: James Michael Moratto, 1515 W. Estes, Chicago, IL (US) 60626

( * ) Notice: Subject to any disclaimer, the term of this patent is extended or adjusted under 35 U.S.C. 154(b) by 0 days.

(21) Appl. No.: 10/441,409

(22) Filed: May 20, 2003

(65) Prior Publication Data

US 2004/0140389 A1 Jul. 22, 2004

Related U.S. Application Data

(60) Provisional application No. 60/381,849, filed on May 20, 2002.

(51) Int. Cl.
*B65H 16/04* (2006.01)

(52) U.S. Cl. ..... 242/597.7; D6/521; 242/597.5

(58) Field of Classification Search ..... 242/597.7, 242/597.5, 597.6, 129, 139, 129.5, 588; D6/518–523; D8/358–359
See application file for complete search history.

(56) References Cited

U.S. PATENT DOCUMENTS

| | | | | |
|---|---|---|---|---|
| 2,500,116 | A * | 3/1950 | Carter et al. | 242/129 |
| 4,184,647 | A * | 1/1980 | Rourke | 242/597.7 |
| 4,273,299 | A * | 6/1981 | Ness | 242/597.7 |
| 4,768,732 | A * | 9/1988 | Greenleaf | 242/597.7 |
| 5,842,655 | A * | 12/1998 | McCarthy | 242/129 |
| 6,557,792 | B1 * | 5/2003 | Snow | 242/597.7 |
| 2002/0066822 | A1 * | 6/2002 | Emes | 242/597.7 |

* cited by examiner

*Primary Examiner*—Emmanuel M Marcelo

(57) ABSTRACT

The invention is a spinning roll dispenser product for dispensing items from a roll, for example a roll of paper towels. The product holds the roll on a spindle and spins around a spindle axis as the items are pulled from the roll. The product has a plurality of wheels and a tapered spindle portion for holding and dispensing the items.

2 Claims, 1 Drawing Sheet

SPINNING PAPER TOWEL HOLDER

This application claims the benefit of provisional application 60/381,849, filed on May 20, 2002. The invention is a spinning roll dispenser product for dispensing items from a roll, for example a roll of paper towels. The items on the roll are wound around a central passage and are dispensed from the roll by pulling an outermost item from the roll.

The product holds the roll on a spindle and spins around a spindle axis as the items are pulled from the roll.

The product rests on a support surface, for example a countertop, and does not require attaching to the surface. The product is transportable between surfaces, for example between the countertop and a tabletop.

The product supports the roll on a base. The base is spaced apart from the support surface by wheels attached to the base. The wheels contact the support surface and hold the base away from the support surface. The wheel-supported base minimizes moisture and debris from collecting between the base and the support surface. The wheel-supported base minimizes dirt and debris transfer when the product is transported from one surface to another surface.

The product holds the roll extended upwardly to minimize space occupied on the support surface. The base spins on the wheels when items are pulled from the roll.

Figure 1:
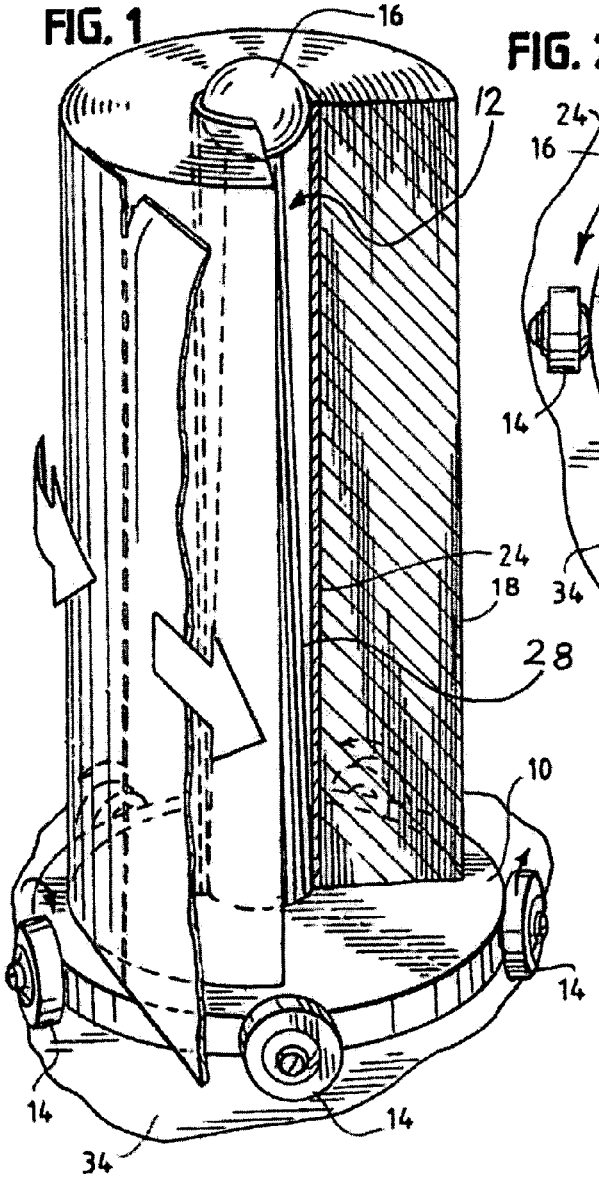
FIG. 1 is a perspective view of an embodiment of the product.
Figure 2:
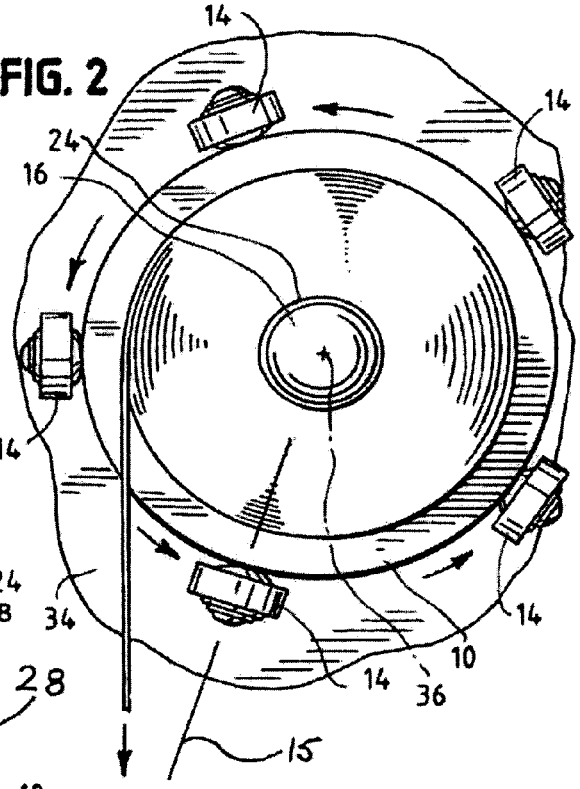
FIG. 2 is a top view of an embodiment.

As shown in FIG. 1 and FIG. 2, the product has a base, for example the cylindrical base 10. The base in use supports the roll 18 and holds the roll away from the support surface 34.

The embodiment shown in FIG. 1 and FIG. 2 has a right, circular cylindrical base. Other bases can have different shapes and configurations, so long as they support the roll spaced apart from the support surface.

The base can be wood, plastic, metal and various other materials and combinations thereof.

The product has a spindle 12 connected to the base. The spindle 12 extends outwards from the base along a spindle axis 36. When the base is in use and supporting the roll, at least a part of the spindle is positioned within the roll central passage. The spindle within the passage positions the roll collinearly with the spindle axis 36.

The spindle 12 extends substantially centrally from the cylindrical base 10. Other embodiments can have the spindle extend from various positions on the base. It is advantageous to have the spindle centrally located on the base so that the base rotates about it's own center.

The spindle has a tapered portion proximal the base. The tapered portion is sized to frictionally engage the roll central passage when the roll is positioned for dispensing items. By engaging the central passage, the tapered portion ensures the roll causes the product to spin and inhibits the roll from moving away from the base when items are dispensed from the roll. This is especially important when there are few items on the roll and when the weight of the roll is insufficient to frictionally engage the base.

In FIG. 1 the tapered portion 28 engages the central passage 24 proximal the base 10. The tapered portion 28 extends substantially along the whole spindle. Other embodiments can have a tapered portion only proximal the base. Alternatively, the spindle can have a tapered portion proximal the base and at other positions along the spindle.

The product has a plurality of wheels, such as the wheel 14. Each wheel from the plurality of wheels rotates around a wheel axis from a plurality of wheel axes, for example the wheel axis 15. Each wheel axis from the plurality of wheel axes is substantially perpendicular to the spindle axis. Each wheel axis extends radially outward from the spindle axis. The positions of the wheels ensure that the product spins substantially around the spindle axis when items are dispensed from the roll.

In the embodiment shown in FIG. 1 and FIG. 2, the wheels are substantially equally spaced around a perimeter of the base. Other embodiments can have the wheels in various other positions, so long as the wheels each have a wheel axis that is substantially perpendicular to and extends radially outward from the spindle axis.

The plurality of wheels supports the base and holds the base spaced apart from the support surface. The base being spaced apart from the support surface provides increased open space between the base and the support surface and minimizes dirt and debris buildup between the base and the support surface. This open space is useful when the product is used in a crowded area such as a kitchen countertop because the product can dispense items when positioned above various small obstructions.

The spindle can have a spindle head. The spindle head is connected to the spindle distal the base. The spindle head fits loosely within the central passage and can slide through the central passage as the roll is positioned on the product. The spindle is useful for maintaining the position of the roll while dispensing items.

In FIG. 1 and FIG. 2 the spindle head 16 is substantially spherical. Other embodiments can have a spindle head with various other shapes and configurations, so long as the spindle head is distal the base and is sized to loosely guide the central passage.

I claim:

1. A spinning dispenser product for dispensing items from a roll, for example a roll of paper towels, the roll having items wound around a central passage so that items can be dispensed from the roll by removing an outermost item from the roll, the product comprising:

a base, the base, in use, supporting the roll;

a spindle extending outward from the base along a spindle axis;

at least part of the spindle, in use, extending into the central passage and positioning the roll for dispensing;

the spindle comprising a tapered portion proximal the base, the tapered portion being sized to frictionally engage the central passage when the roll is positioned for dispensing;

a plurality of wheels, each wheel from the plurality of wheels having a wheel axis, each wheel axis extending substantially radially outward from the spindle axis and substantially perpendicular to the spindle axis, and the plurality of wheels supporting the base in spaced-apart relation to a support surface so that the product spins around the spindle axis on the plurality of wheels when an item is dispensed from the roll of items.

2. The product of claim 1 wherein the spindle further comprises:

a spindle head, the head being connected to the spindle distal the base; and the head being sized to loosely guide the central passage and to substantially align the roll with the spindle axis.

* * * * *